US008689773B2

(12) United States Patent
Walterscheid et al.

(10) Patent No.: US 8,689,773 B2
(45) **Date of Patent: *Apr. 8, 2014**

(54) TOY PROJECTILE LAUNCHER

(75) Inventors: Steve Walterscheid, Bend, OR (US); Brian K. Lapointe, South Dennis, MA (US); Peter Cummings, Kowloon (HK)

(73) Assignee: KMA Concepts Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 13/411,951

(22) Filed: Mar. 5, 2012

(65) Prior Publication Data

US 2012/0160224 A1 Jun. 28, 2012

Related U.S. Application Data

(63) Continuation-in-part of application No. 12/878,985, filed on Sep. 9, 2010, now Pat. No. 8,662,060.

(51) Int. Cl.
*F41B 5/00* (2006.01)

(52) U.S. Cl.
USPC ..... 124/23.1

(58) Field of Classification Search
USPC ..... 124/20.3, 20.1
See application file for complete search history.

(56) References Cited

U.S. PATENT DOCUMENTS

| | | | | |
|---|---|---|---|---|
| 5,247,920 | A | 9/1993 | Harbin | |
| 7,748,369 | B2 | 7/2010 | Chee | |
| 2009/0032002 | A1 * | 2/2009 | Howard et al. | 124/25.6 |

* cited by examiner

*Primary Examiner* — Gene Kim
*Assistant Examiner* — Amir Klayman
(74) *Attorney, Agent, or Firm* — LaMorte & Associates P.C.

(57) ABSTRACT

A toy projectile launching system that launches a toy projectile. The launcher has a handle. The handle is offset between two supports. A first arm element is coupled to the first support. A first elastic loop is anchored to the first arm element. The first elastic loop has a looped section that extends into an open area. A second arm element is coupled to the second support. A second elastic loop is anchored to the second arm element. The second elastic loop has a looped section that extends into the open area. The looped sections of the first elastic loop and the second elastic loop are spaced to receive and engage opposing hook elements on the toy projectile when the toy projectile is manually drawn through the open area.

11 Claims, 6 Drawing Sheets

TOY PROJECTILE LAUNCHER

RELATED APPLICATIONS

This application is a continuation-in-part of U.S. patent application Ser. No. 12/878,985, entitled Toy Bow And Arrow System And Method Of Configuration

BACKGROUND OF THE INVENTION

1. Field of the Invention

In general, the present invention relates to toy bow and arrow systems, where a toy bow is used to launch a toy arrow projectile into flight.

2. Prior Art Description

Bow and arrow sets that are designed for children's play have existed throughout recorded history. In the modern era, toy bow and arrow sets typically have a plastic molded bow, a string and safety-tipped arrows. To ensure safety, the functional design of the bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string can break and will most likely move in a direction away from the person drawing the bow. The failure mode of a string breaking is far less dangerous than the failure mode of the bow breaking. However, the failure mode of broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly.

Although toy bows with elastic strings are safer than flexible bows with non-elastic strings, a danger still is present. If an elastic string is stretched into a fully drawn state and the elastic string breaks near its mounting point with the bow, then the broken elastic string may whip toward the person pulling on the elastic string. The broken elastic string therefore has the potential to cause physical danger to the child pulling on the string, especially to the eyes of that child.

A need therefore exists for a toy bow and arrow design that eliminates the dangers to a child who may overdraw the bow to a point of string failure. This need is met by the present invention as described and claimed below.

SUMMARY OF THE INVENTION

The present invention is a toy projectile launching system that launches a toy projectile. The toy projectile has at least two hook elements extending from it that are engaged by the launcher. The launcher has a handle. The handle has a first end and a second end. A first support extends from the handle proximate its first end. Likewise, a second support extends from the handle proximate its second end. As a result, an open area is defined on three sides by the handle, the first support and the second support.

A first arm element is coupled to the first support. A first elastic loop is anchored to the first arm element. The first elastic loop has a looped section that extends into the open area. A second arm element is coupled to the second support. Likewise, a second elastic loop is anchored to the second arm element. The second elastic loop has a looped section that extends into the open area. The looped sections of the first elastic loop and the second elastic loop are spaced to receive and engage the opposing hook elements on the toy projectile when the toy projectile is manually drawn through the open area.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy bow and arrow system can be embodied in many ways, only two embodiments of the present invention system are illustrated. These embodiments are selected in order to set forth the best modes contemplated for the invention. The illustrated embodiments, however, are merely exemplary and should not be considered limitations when interpreting the scope of the appended claims.

Figure 1:
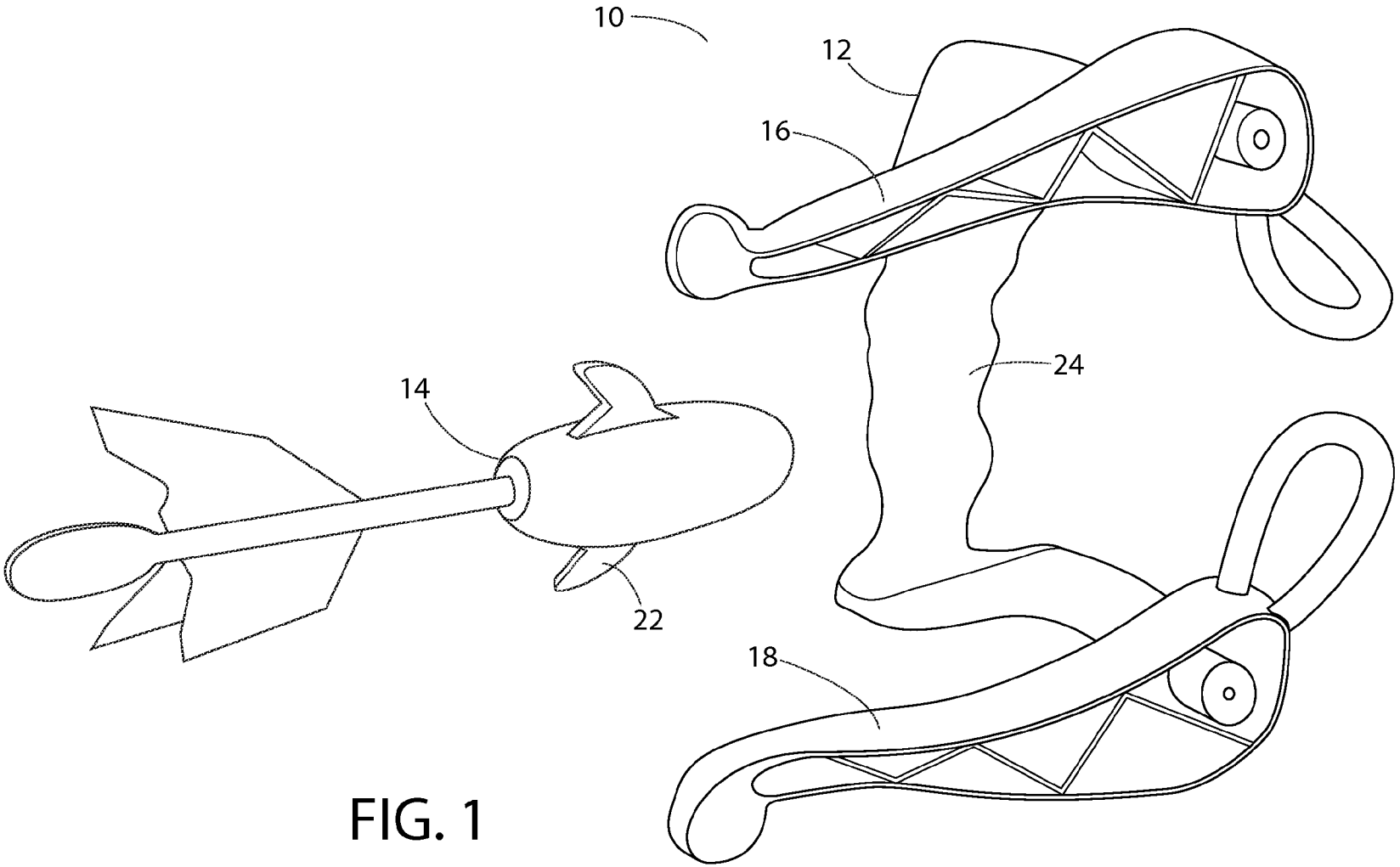
FIG. 1 is a perspective view of an exemplary embodiment of a toy launcher and toy projectile in combination.

Referring to FIG. 1, a projectile launching system 10 is shown. The projectile launching system 10 includes a launcher 12 and at least one toy projectile 14. The launcher 12 includes two spring-loaded arm elements 16, 18. The force used to propel the toy projectile 14 is provided by the spring energy stored by the spring-loaded arm elements 16, 18 and the stretching of two elastic loops 19, 20 that extend from the arm elements 16, 18. The toy projectile 14 has hook projections 22 that engage both of the elastic loops 19, 20. As a person engages the toy projectile 14 with the elastic loops 19, 20 and pulls on the toy projectile 14, both elastic loops 19, 20 stretch. Since there are two elastic loops 19, 20, each of the elastic loops 19, 20 need only provide half the force needed to propel the toy projectile 14 into flight. The elastic loops 19, 20 are therefore difficult to overstretch in the proper operation of the projectile launching system 10. Should either of the elastic loops 19, 20 suddenly break, the orientation of the broken elastic loops 19, 20 prevents them from whipping toward the user. Furthermore, since the toy projectile 14 engages two separate and distinct elastic loops 19, 20, the chance of both elastic loops 19, 20 breaking simultaneously is highly improbable. Accordingly, if one elastic loop breaks, the toy projectile 14 will still be engaged with the second elastic loop and the person pulling the toy projectile 14 will not pull the toy projectile 14 into himself upon the breakage of the one elastic loop.

Figure 2:
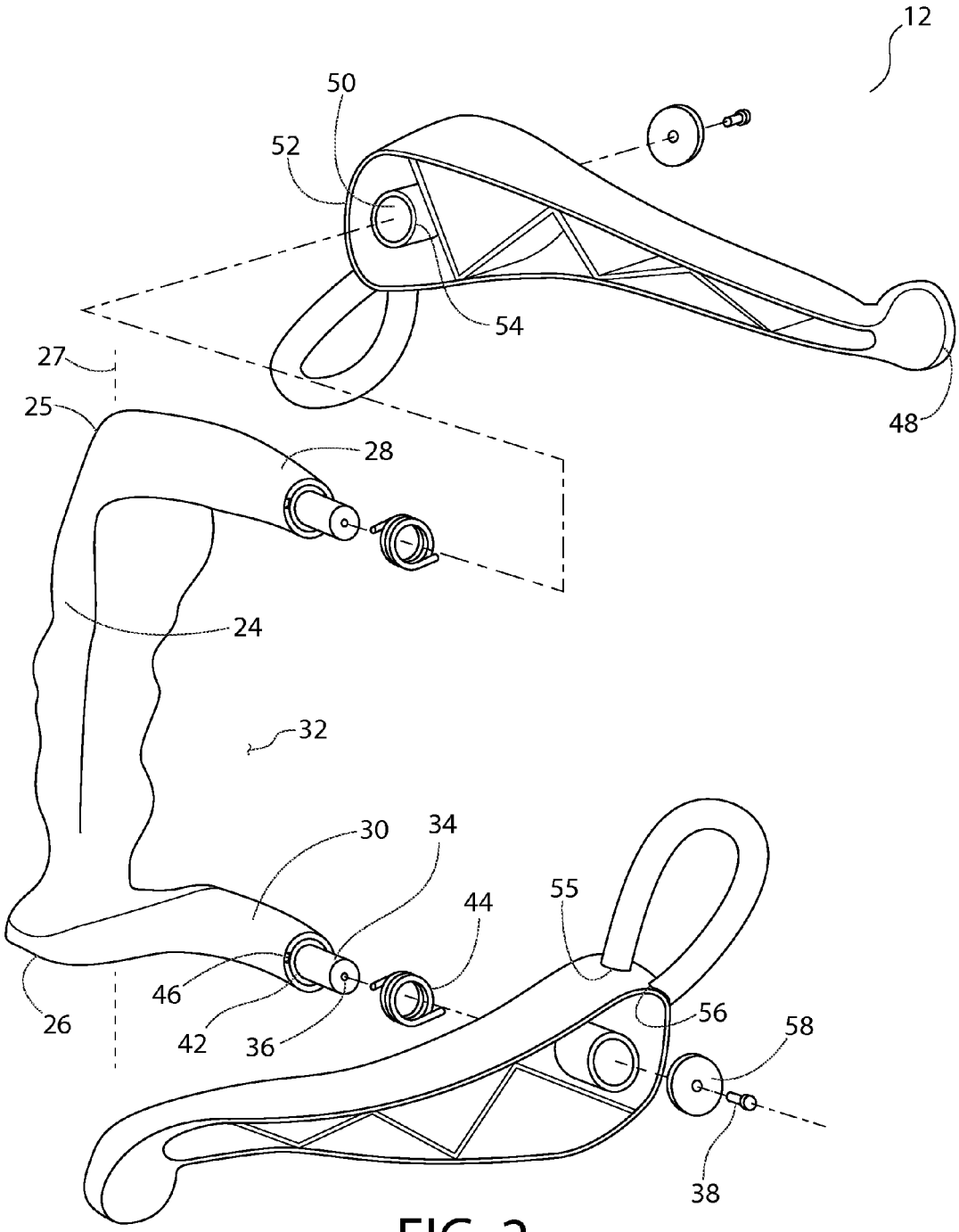
FIG. 2 is an exploded perspective view of a side view of the launcher shown in FIG. 1.

Referring to FIG. 2 in conjunction with FIG. 1, it can be seen that the launcher 12 includes a handle 24. The handle 24 has a first end 25 and an opposite second end 26. The handle 24 is preferably a rigid plastic molding that progresses along a primary longitudinal axis 27. Two supports 28, 30 extend from the handle 24. The first support 28 extends from the handle 24 proximate its first end 25 and the second support 30 extends from the handle 24 proximate its second end 26. As an assembly, the handle 24 and the two supports 28, 30 form a generally C-shaped structure that defines three sides of a central open area 32.

The bottom of each support 28, 30 is coupled to the handle 24. The top of each support 28, 30 terminates with a pivot post 34. Each pivot post 34 is oriented at a right angle to the longitudinal axis 27 of the holding handle 24. As such, when the handle 24 is held in a vertical orientation, both pivot posts 34 will extend in a horizontal orientation.

A bore 36 is formed in the top center of each of the pivot posts 34. Each bore 36 is used to receive an assembly screw 38, as is later explained. At the bottom of each of the pivot posts 34, the supports 28, expand. This creates a ledge 40 around the bottom of each pivot post 34. A recess 42 is formed just below the ledge 40 that is sized to receive a torsion spring 44. At least one stop 46 is formed on each ledge 40 for a purpose that will later be explained.

Two arm elements 16, 18 are provided. Each arm element 16, 18 has a first end 48, a second end 52 and a mounting hole 50 that extends through each of the arm elements 16, 18 near their second ends 52. A guide groove 54 is formed partially around each mounting hole 50 for a purpose that is later explained.

Elastic loops 19, 20 extend from the second ends 52 of the arm elements 16, 18. The elastic loops 19, are made from strands of highly elastic elastomeric material that enables each elastic loop 19, 20 to resiliently stretch at least threefold without breaking. The elastic loops 19, 20 are made from different material than is the remainder of the rigid arm elements 16, 18. Accordingly, it will be understood that the elastic loops 19, 20 are mechanically anchored to the arm elements 16, 18. Each arm element 16, 18 defines two holes 55, 56 proximate its second end 52. The elastic loop extends through these holes 55, 56. The holes 55, 56 are spaced at least ¼ inch apart. This spreads each of the elastic loops 19, 20 and helps the elastic loops 19, 20 maintain an open loop configuration at all times.

The arm elements 16, 18 attach to the supports 28, 30 by passing the pivot posts 34 through the mounting holes 50 of the arm elements 16, 18. The arms elements 16, 18 are free to rotate about the pivot posts 34 through a predetermined range of motion. The range of motion is approximately ninety degrees. When the arm elements 16, 18 are placed onto the pivot posts 34, the stops 46 on the ledge 40 of the supports 28, 30 engage the guide groove 54 that surrounds the mounting hole 50. The position of the stops 46 and the shape of the guide groove 54 enables each of the arm elements 16, 18 to rotate only ninety degrees about the pivot posts 34 between an uncocked position and a cocked position.

The torsion spring 44 is positioned around each pivot post 34. The torsion springs 44 engage both the arm elements 16, 18 and the supports 28, 30. The torsion springs 44 apply a biasing force to the arm elements 16, 18 that bias the arm elements 16, 18 into their uncocked positions. It will therefore be understood that the arm elements 16, 18 are spring loaded into their uncocked positions.

The arm elements 16, 18 are prevented from moving off the pivot posts 34 by end caps 58 that get mounted to the top of the pivot posts 34 with screws 38.

When the launcher 12 is fully assembled, the handle 24 is offset from the plane of the arm elements 16, 18 by the supports 28, 30. This defines the open area 32 between the arm elements 16, 18. The elastic loops 19, 20 extend into this open area 32 from opposite sides.

Figure 3:
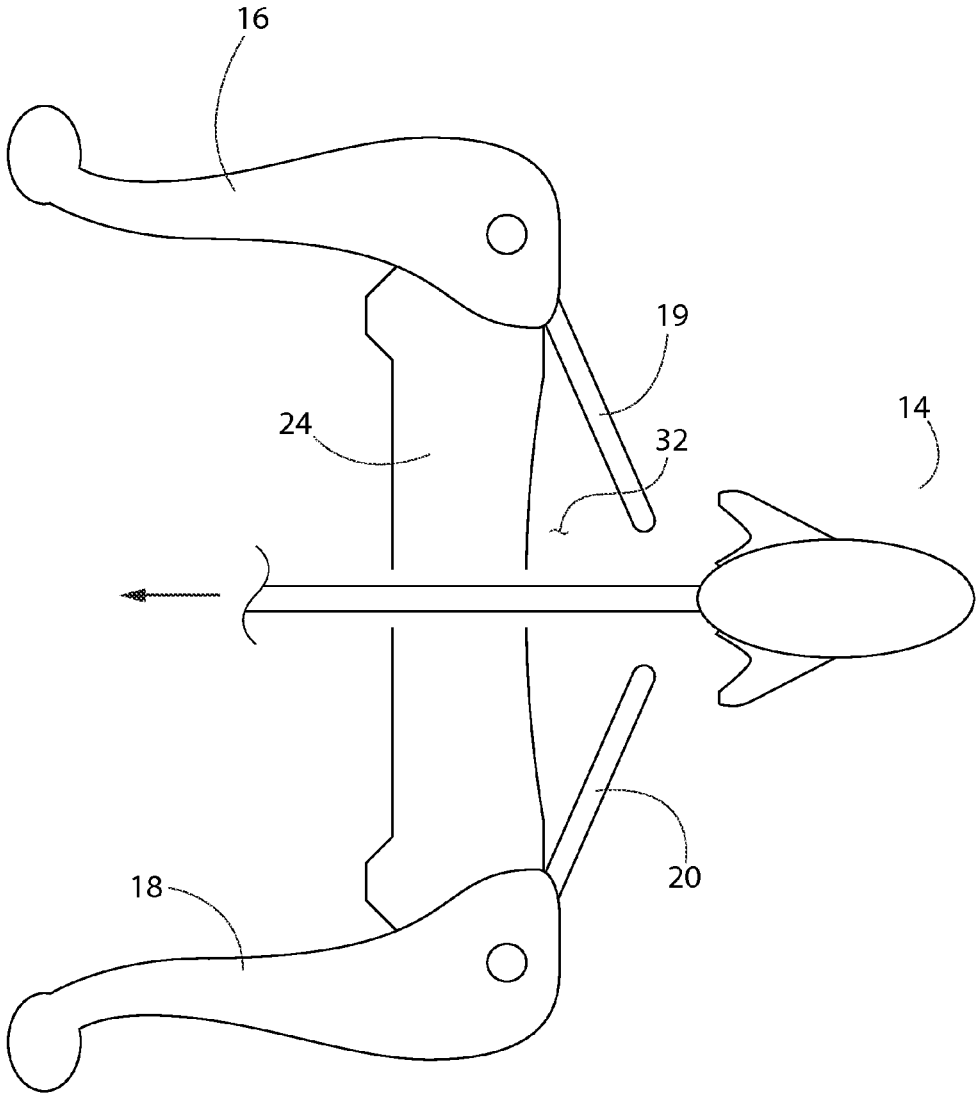
FIG. 3 is a side view of the launcher with a segment of the toy projectile, the launcher is shown in an uncocked position.
Figure 4:
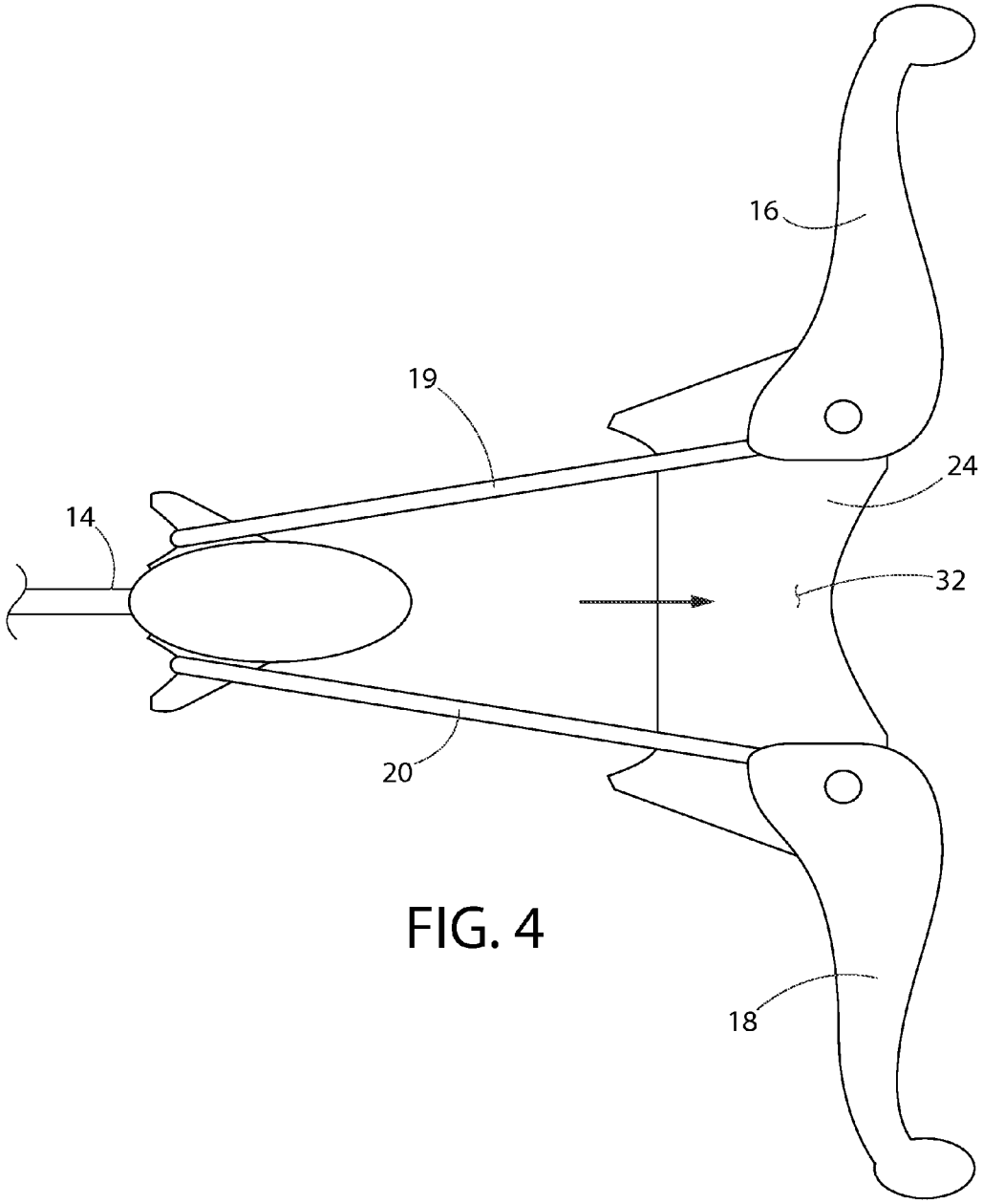
FIG. 4 is a side view of the launcher with a segment of the toy projectile, the launcher is shown in a cocked position.

Referring to both FIG. 3 and FIG. 4 in combination with FIG. 2, it can be seen that the toy projectile 14 has two hook projections 22 extending from opposite sides. The hook projections 22 are sized and shaped to engage the two elastic loops 19, 20 as the hook projections 22 are pulled through the open area 32.

To load the toy projectile 14, the toy projectile 14 is drawn through the open area 32 so that the hook projections 22 engage the elastic loops 19, 20. Once engaged with the elastic loops 19, 20, the toy projectile 14 is pulled in the manner of a traditional bow and arrow. As the toy projectile 14 is drawn away from the open area 32, the elastic loops 19, 20 stretch. As the elastic loops 19, 20 stretch, they apply a torque to the arm elements 16, 18. When the force of the applied torque supersedes the bias of the torsion spring 44, each of the arm elements 16, 18 rotate about the pivot posts 34 from the original uncocked position (FIG. 3) to a ready-to-fire cocked position (FIG. 4).

As the elastic loops 19, 20 stretch, they store energy. Furthermore, as the arm elements 16, 18 move in opposition of the torsion springs 44, the torsion springs 44 store energy. When the toy projectile 14 is released, the elastic loops 19, 20 retract. The arm elements 16, 18 spring back to their uncocked positions and the toy projectile 14 is accelerated through the open area 32. At the open area 32, the momentum of the toy projectile 14 causes the toy projectile 14 to continue its forward movement past the open area 32. This launches the toy projectile 14 into flight as the hook projections 22 disengage the elastic loops 19, 20.

The rotation of the arm elements 16, 18 from the uncocked position (FIG. 3) to the cocked position (FIG. 4) provides a clear visual indicator as to when the bow launcher 12 is ready to launch the toy projectile 14. The strength of the torsion springs 44 are coordinated with the strength of the elastic loops 19, 20. In this manner, the arm elements 16, 18 rotate to the fully cocked positions (FIG. 4) just as the elastic loops 19, 20 reach their optimal degree of elongation. In this manner, a child playing with the launcher 12 can easily see when the launcher 12 is ready to be fired at its optimal strength. Likewise, the visual indication will help prevent a child from pulling too hard on the toy projectile 14 and stressing the elastic loops 19, 20 to the point of breakage.

Figure 5:
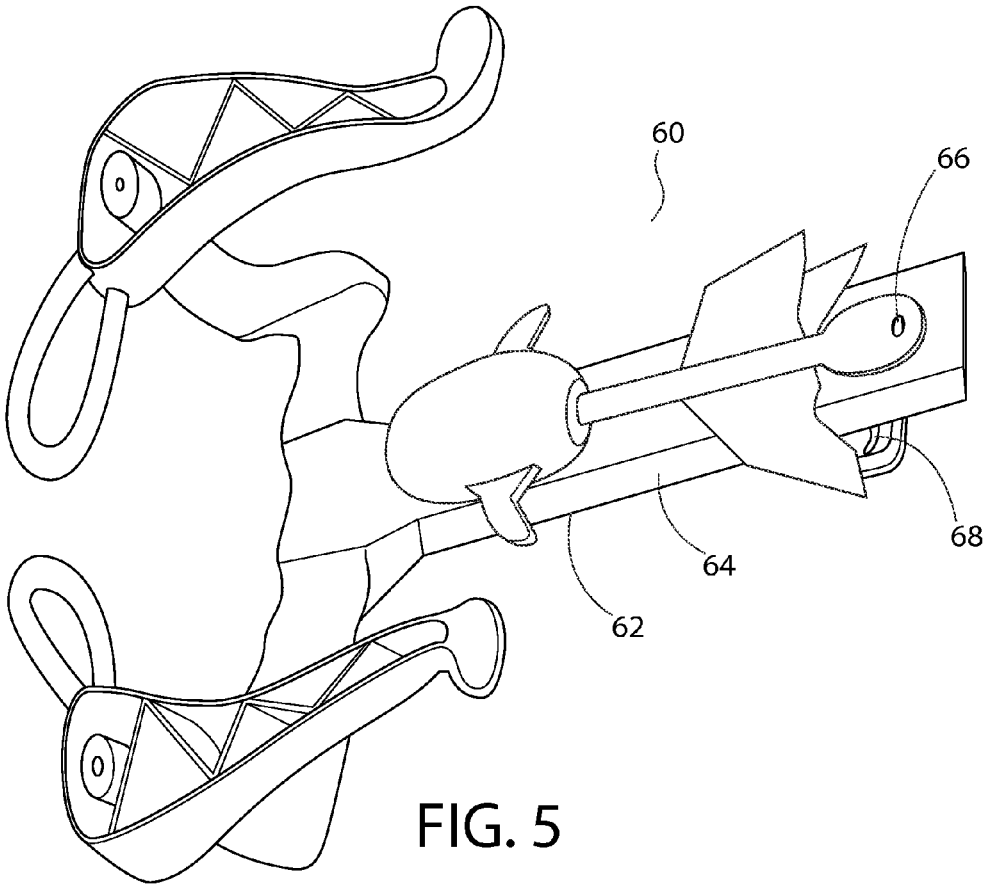
FIG. 5 shows a perspective view of an alternate embodiment of the toy launcher configured as a crossbow.

Referring to FIG. 5, an alternate embodiment of a launcher 60 is shown. In this embodiment, the launcher 60 is configured as a crossbow 62. The crossbow 62 has arm elements 16, 18 and elastic loops 19, 20 that are the same as was previously explained. The only difference is that the handle is now part of a stock 64 that can hold a toy projectile 14 in a loaded position. A catch 66 is provided on the stock 64 that engages the toy projectile 14 and prevents it from launching. The catch 66 is operated by a trigger mechanism 68 that is positioned under the stock 64. When a user activates the trigger mechanism 68, the toy projectile 14 is released by the catch 66 and the toy projectile 14 is launched into flight.

Figure 6:
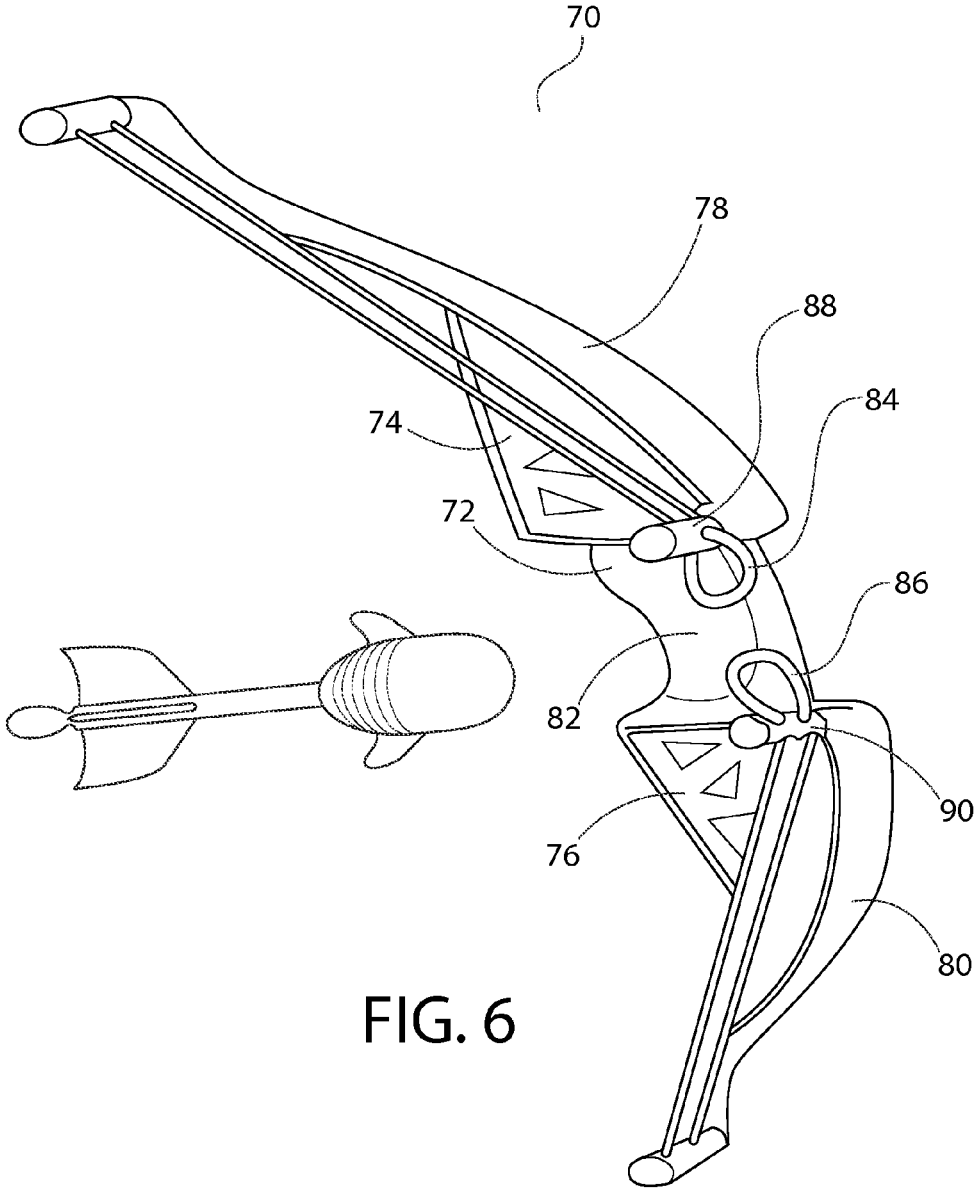
FIG. 6 shows a side view of an alternate embodiment of a launcher having static arm elements.

In the previous embodiments, the arm elements of the launcher are spring loaded. However, this need not be the case. The toy launcher can still be made effective even if the arms are made static. Referring now to FIG. 6, such an embodiment is shown. In this embodiment, the toy launcher 70 is made with a handle 72 that is offset between two supports 74, 76, as with the earlier embodiment. Two static arm elements 78, 80 are rigidly joined to the handle 72 via the supports 74, 76. The first arm element 78 and the second arm element 80 are disposed in a common plane. The handle 72 is offset from the common plane by the supports 74, 76 so as not to interfere with the path of the toy projectile 14. This creates an open central area 82 between the first and second arm elements 78, 80.

Two elastic loops 84, 86 extend into the open central area 82. The loops 84, 86 engage a toy projectile in the manner previously described. Since the arm elements 78, 80 are not spring loaded, it is only the strength of the elastic loops 84, 86 that provide the energy needed to launch the toy projectile. The strength of the elastic loops 84, 86 can be increased by increasing the size of the elastic loops 84, 86 and therefore the amount of elastic material embodied by the elastic loops 84, 86.

In the launcher 70 of FIG. 6, two rigid guide posts 88, 90 are provided. One post 88 is directly above the open central area 82, the other directly below the open central area 82. The elastic loops 84, 86 are much longer than in the previous embodiments. The first elastic loop 84 is anchored to the top of the first arm element 78. The first elastic loop 84 extends through openings in the first guide post 88. The first guide post 88 retains the looped section 92 of the elastic loop 84 in the open central area 82. Likewise, the second elastic loop 86 is anchored to the far end of the second arm element 80. The second elastic loop 86 extends through openings in the second guide post 90. The second guide post 90 retains the looped section 94 of the second elastic loop 86 in the open central area 82.

When a toy projectile engages the first and second elastic loops 84, 86, the entire length of the elastic loops 84, 86 can stretch. This provides the energy needed to propel the toy projectile into flight without the use of spring loaded arms.

It will be understood that the embodiments of the present invention that are illustrated and described are merely exemplary and that a person skilled in the art can make many variations to those embodiments. For instance, the bow structure can have many different ornamental shapes. Likewise, the toy projectiles can be configured as airplanes, rocket ships or any other flying projectile. All such embodiments are intended to be included within the scope of the present invention as defined by the claims.

What is claimed is:

1. A launching system for launching a toy projectile, said system comprising:

a toy projectile having opposing hook elements extending therefrom;

a handle having a first end and a second end;

a first arm element coupled to said handle proximate said first end;

a second arm element coupled to said handle proximate said second end, wherein said first arm element and said second arm element are coplanar and said handle is offset from said first arm element and said second arm element, therein forming an open central area adjacent said handle and between said first arm element and said second arm element;

a first elastic loop attached to said first arm element, wherein said first elastic loop extends freely into said open central area;

a second elastic loop attached to said second arm element, said first elastic loop being separate and distinct from said second elastic loop, wherein said second elastic loop extends freely into said open central area, and wherein said first elastic loop and said second elastic loop are spaced to receive and engage said opposing hook elements on said toy projectile.

2. The system according to claim 1, further including a first support that connects said first arm element to said handle, and a second support that connects said second arm element to said handle, therein causing said handle to be offset from both said first arm element and said second arm element.

3. The system according to claim 2, wherein said first elastic loop is anchored to said first arm element and said second elastic loop is anchored to said second arm element.

4. The system according to claim 3, wherein said first arm element is connected to said first support at a first pivot connection and said second arm element is connected to said second support at a second pivot connection.

5. The system according to claim 4, wherein said first arm element is free to rotate about said first pivot connection through a predetermined range between an uncocked position and a cocked position.

6. The system according to claim 5, wherein said predetermined range is about ninety degrees.

7. The system according to claim 4, wherein said second arm element is free to rotate about said second pivot connection through a predetermined range between an uncocked position and a cocked position.

8. The system according to claim 7, wherein said predetermined range is about ninety degrees.

9. The system according to claim 5, further including a first spring that biases said first arm element into said uncocked position.

10. The system device according to claim 7, further including a second spring that biases said second arm element into said uncocked position.

11. The system device according to claim 4, wherein said handle is configured as a crossbow stock.

* * * * *